US005382926A

United States Patent [19]

Nakahara et al.

[11] Patent Number: 5,382,926

[45] Date of Patent: Jan. 17, 1995

[54] MULTIPLE BIT LOADED LINE PHASE SHIFTER

[75] Inventors: Kazuhiko Nakahara; Shinji Aono, both of Itami, Japan

[73] Assignee: Mitsubishi Denki Kabushiki Kaisha, Tokyo, Japan

[21] Appl. No.: 72,956

[22] Filed: Jun. 8, 1993

[30] Foreign Application Priority Data

Jun. 19, 1992 [JP] Japan ..... 4-186084
May 10, 1993 [JP] Japan ..... 5-107918

[51] Int. Cl.[6] ..... H01P 1/185
[52] U.S. Cl. ..... 333/161; 333/164
[58] Field of Search ..... 333/138–140, 333/156, 161, 164, 103

[56] References Cited

U.S. PATENT DOCUMENTS 5,032,806 7/1991 Nakahara ..... 333/161
5,039,873 8/1991 Sasaki ..... 307/262

FOREIGN PATENT DOCUMENTS 61-208307 9/1986 Japan .
370201 9/1991 Japan .
0244201 10/1991 Japan ..... 333/164

*Primary Examiner*—Seungsook Ham
*Attorney, Agent, or Firm*—Leydig, Voit & Mayer

[57] ABSTRACT

A loaded line phase shifter includes a semiconductor substrate; a main transmission line one-quarter wavelength long disposed on the semiconductor substrate; loaded lines connected to opposite ends of the main line; first and second FETs with drain electrodes connected to the other ends of the loaded lines and grounded source electrodes; and a resonant circuit including a third FET and an inductor connected between the drain electrodes of said first and second FETs. A desired phase shift quantity of the phase shifter is determined by the characteristic impedance of the main line, the reactance components of the loaded lines, and the off-capacitances of the FETs. When the resonant circuit is closed in this structure, the susceptance of the loaded lines and the first and second FETs is equal to zero, resulting in a phase shift quantity equivalent to half of the phase shift quantity obtained when the resonant circuit is opened. Therefore, two different phase shift quantities are achieved in one phase shifter, resulting in a small-sized multiple-bit phase shifter.

5 Claims, 11 Drawing Sheets

MULTIPLE BIT LOADED LINE PHASE SHIFTER

FIELD OF THE INVENTION

The present invention relates to a loaded line phase shifter and, more particularly, to a shifter providing two different phase shift quantities that is a small-sized multiple bit phase shifter.

BACKGROUND OF THE INVENTION

FIG. 12 is a perspective view of a prior art loaded line phase shifter and FIG. 13 is an equivalent circuit diagram thereof. In the figures, reference numeral 120 designates a loaded line phase shifter. In the loaded line phase shifter 120, a main transmission line 3 one-quarter of a wavelength long is disposed on a semiconductor substrate 12 comprising silicon, GaAs, or the like. An input pad (input terminal) 1 and an output pad (output terminal) 2 are disposed at opposite ends of the main line 3. Loaded lines 4*a* and 4*b* are connected to the main line 3 in the vicinity of the input and output pads 1 and 2, respectively. Field effect transistors (hereinafter referred to as FETs) 5*a* and 5*b* are connected to ends of the loaded lines 4*a* and 4*b*, respectively. The FET 5*a* includes a drain 7, a source 9, and a gate 8, and the FET 5*b* includes a drain 10, a source 9, and a gate 11. The source 9 is common to the FETs 5*a* and 5*b*, through which the FETs 5*a* and 5*b* are grounded. Gate bias pads (gate bias terminals) 6*a* and 6*b* are connected to the gates 8 and 11, respectively. The common source 9 is grounded by a wire 13 comprising gold or the like.

FIG. 14 is an equivalent circuit diagram of the loaded line phase shifter of FIG. 12, in which the FETs 5*a* and 5*b* are included in the loaded lines 4*a* and 4*b*. In FIG. 14, Zc is characteristic impedance of the main line 3, $\theta$ is electrical length of the main line 3, Yi is admittance of a loaded line 4*a*' (4*b*') including the loaded line 4*a* (4*b*) and the FET 5*a* (5*b*), and Zo is characteristic impedance of the whole phase shifter.

A description is given of the operation.

In a circuit shown in FIG. 15, it is supposed that impedances when the circuit is viewed from the input and output terminals are equal to impedances when the input and output terminal are viewed from the circuit and the transmission quantity is equal to $\phi$. Such a circuit can be represented by a K matrix. A plurality of such circuits can be connected in cascade.

In order to represent the loaded line phase shifter shown in FIG. 13 by a K matrix, admittance Yi of the load including the loaded line 4*a* (4*b*) and the FET 5*a* (5*b*) is represented in a K matrix as follows:

$$K1 = \begin{pmatrix} 1 & 0 \\ Yi & 1 \end{pmatrix} \tag{1}$$

Meanwhile, characteristic impedance of the main line 3 is represented in a K matrix as follows:

$$K2 = \begin{pmatrix} \cos\theta & jZc\sin\theta \\ j\frac{1}{Zc}\sin\theta & \cos\theta \end{pmatrix} \tag{2}$$

Therefore, the whole loaded line phase shifter is represented in K matrix as follows:

$$K = \begin{pmatrix} A & B \\ C & D \end{pmatrix} = K1 \cdot K2 \cdot K1 \tag{3}$$

$$= \begin{pmatrix} 1 & 0 \\ Yi & 1 \end{pmatrix} \begin{pmatrix} \cos\theta & jZc\sin\theta \\ j\frac{1}{Zc}\sin\theta & \cos\theta \end{pmatrix} \begin{pmatrix} 1 & 0 \\ Yi & 1 \end{pmatrix}$$

Since the admittance Y is represented by conductance G and susceptance B, the admittance Yi of the load including the loaded line 4*a* (4*b*) and the FET 5*a* (5*b*) is represented as follows:

$$Yi = Gi + jBi \tag{4}$$

When the equation (4) is substituted for the equation (3), respective components A, B, C, and D of the K matrix are represented as follows:

$$A = D = \cos\theta - Bi\,Zc\sin\theta + jZc\,Gi\sin\theta \tag{5}$$

$$B = jZc\sin\theta \tag{6}$$

$$C = 2GI(\cos\theta - Bi\,Zc\sin\theta) + jZc(2Bi\,Yc\cos\theta + Yc^2 + Gi^2 - Bi^2)\sin\theta \tag{74}$$

When this K matrix is converted to S parameters, since the loaded line phase shifter shown by the equivalent circuit of FIG. 13 is a symmetrical circuit, the following equations (8) and (9) are obtained.

$$S11 = S22 = \frac{BYo - CZo}{2A + BYo + CZo} \tag{8}$$

$$S12 = S21 = \frac{2}{2A + BYo + CZo} \tag{9}$$

where Yo is admittance and Zo is impedance.

When it is supposed that the loaded line phase shifter shown in FIG. 13 has no reflection and no loss, the above-described S11, S21, and Gi are represented as follows:

$$S11 = 0 \tag{10}$$

$$|S21| = 1 \tag{11}$$

$$Gi = 0 \tag{12}$$

When the equation (10) is combined, the equation (8) is converted to $$BYo = CZo \tag{13}$$

When the equations (5), (6), (7), (8), and (12) are substituted, the equation (9) is converted to $$S12 = S21 = \frac{1}{A + BYo} \tag{14}$$

$$= \frac{1}{\cos\theta - Bi\,Zc\sin\theta + jZc\,Yo\sin\theta}$$

When the equation (14) is multiplied by its conjugate formula, the following equation is obtained.

$$S12 = S21 = \cos\theta - Bi\,Zc\sin\theta - jZc\,Yo\sin\theta \tag{15}$$

When the transmission quantity of this phase shifter is $\phi$, the following equations are obtained from the above equation (15).

$$\cos\phi = \cos\theta - Bi\,Zc\sin\theta \quad (16)$$

$$\sin\phi = jZc\,Yo\sin\theta \quad (17)$$

Since the main line 3 is one-quarter wavelength long, i.e., $\theta$ is 90° and reflected waves at the input and output ends cancel each other, so the equations (16) and (17) are respectively reduced to $$\cos\phi = -Bi\,Zc \quad (18)$$

$$\sin\phi = -jZc\,Yo \quad (19)$$

and the transmission quantity $\phi$ is represented as follows:

$$\phi = \cos^{-1}(-Bi\,Zc) \quad (20)$$

FIGS. 16(*a*) and 16(*b*) are equivalent circuit diagrams of the loaded line phase shifter of FIG. 12 illustrating states before and after the phase of the phase shifter is shifted, respectively FIG. 16(*a*) shows a state where the FETs 5*a* and 5*b* are turned on and FIG. 16(*b*) shows a state where the FETs 5*a* and 5*b* are turned off.

When the impedance and the electrical length of the loaded line 3 are ZL and $\theta$L, respectively, and the off-capacitance of the FET is C, the susceptance component B1 of the loaded line 3 in the state of FIG. 16(*a*) is represented by $$B1 = -1/ZL\tan\theta L \quad (21)$$

and susceptance component B2 of the loaded line 3 in the state of FIG. 16(*b*) is represented by $$B2 = \frac{-\frac{1}{\omega C}\tan\theta L - ZL}{ZL\left(-\frac{1}{\omega C} + ZL\tan\theta\right)} \quad (22)$$

where $\omega$ is angular frequency.

Generally, signals traveling through a phase shifter are represented by vectors as shown in FIG. 17, and signals traveling through the phase shifter in the states of FIGS. 16(*a*) and 16(*b*) correspond to vectors OD and OE of FIG. 17, respectively. Therefore, the following equation (23) is obtained from FIG. 17 and the equations (18) and (19), and the following equations (24) and (25) are obtained from the equations (23), (21), and (22).

$$B1 = -B2 \quad (23)$$

$$\frac{-1}{ZL + \tan\theta} = \frac{-\frac{1}{\omega C}\tan\theta - ZL}{ZL\left(-\frac{1}{\omega C} + ZL\tan\theta\right)} \quad (24)$$

$$\omega C = \frac{1 - \tan^2\theta L}{2ZL\tan^2\theta L} \quad (25)$$

As described above, in the conventional loaded line phase shifter shown in FIGS. 12 and 13, values of Zc, L, and C are obtained from the equations (18), (19), (21), and (22).

In the conventional loaded line phase shifter thus constituted, the reactance L of the loaded line, the off-capacitance C of the FET, and the characteristic impedance Zc of the main line are controlled to attain a desired phase shift quantity.

However, in the structure of the conventional loaded line phase shifter comprising a main line, two loaded lines connected to opposite ends of the main line, and two source-grounded FETs connected to the loaded lines, however, only one phase shift quantity is determined. When a two-bit phase shifter is desired, two phase shifters having different phase shift quantities should be connected in cascade, increasing the size of the whole phase shifter.

Meanwhile, the inventor of the present invention proposed an improved loaded line phase shifter in Japanese Published Patent Application No. 3-70201 which corresponds to U.S. Pat. No. 5,032,806, in which two loaded lines are connected to opposite ends of a main line, a source electrode and a drain electrode of an FET are respectively connected to positions spaced from the nodes of the loaded lines and the main line by the same electrical length, and a bias circuit comprising a strip-line for controlling a bias voltage is connected to a gate electrode of the FET. In this phase shifter, since susceptance values of two loaded lines are controlled by one FET and it is not necessary to ground the source electrode, the degree of freedom in pattern design is increased. However, as in the conventional loaded line phase shifter shown in FIG. 12, since only one phase shift quantity is obtained by one phase shifter, two phase shifters have to be connected together to make a two-bit phase shifter.

SUMMARY OF THE INVENTION

It is an object of the present invention to provide a loaded line phase shifter that has two different phase shift quantities and reduced size for a multiple-bit phase shifter.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to a first aspect of the present invention, in a loaded line phase shifter, two loaded lines are connected to opposite ends of a main transmission line, first and second FETs, source electrodes of which are grounded, are connected to the other ends of the loaded lines, and a resonance circuit comprising a third FET and an inductor is connected between the drain electrodes of the two FETs. In this structure, when the resonance circuit is closed, the susceptance of the load comprising the loaded lines and the first and second FETs is zero, resulting in a phase shift quantity equivalent to half of the phase shift quantity obtained when the resonance circuit is open. As a result, two different phase shift quantities are obtained in one phase shifter.

According to a second aspect of the present invention, source and drain electrodes of the third FET of the resonance circuit also serve as the drain electrodes of the first and second FETs connected to the loaded lines, and the inductor is connected between the source and drain electrodes of the third FET, i.e., in parallel with the third FET. Therefore, the size of the loaded line phase shifter is reduced.

According to a third aspect of the present invention, the resonance circuit comprises two FETs connected in series, two inductors respectively connected between source and drain electrodes of the FETs, i.e., in parallel therewith, and a variable resistance connected to a node of the two FETs. Therefore, the half phase shift quantity obtained when the resonance circuit is closed can be precisely controlled

DETAILED DESCRIPTION OF THE PREFERRED EMBODIMENTS

Figure 1:
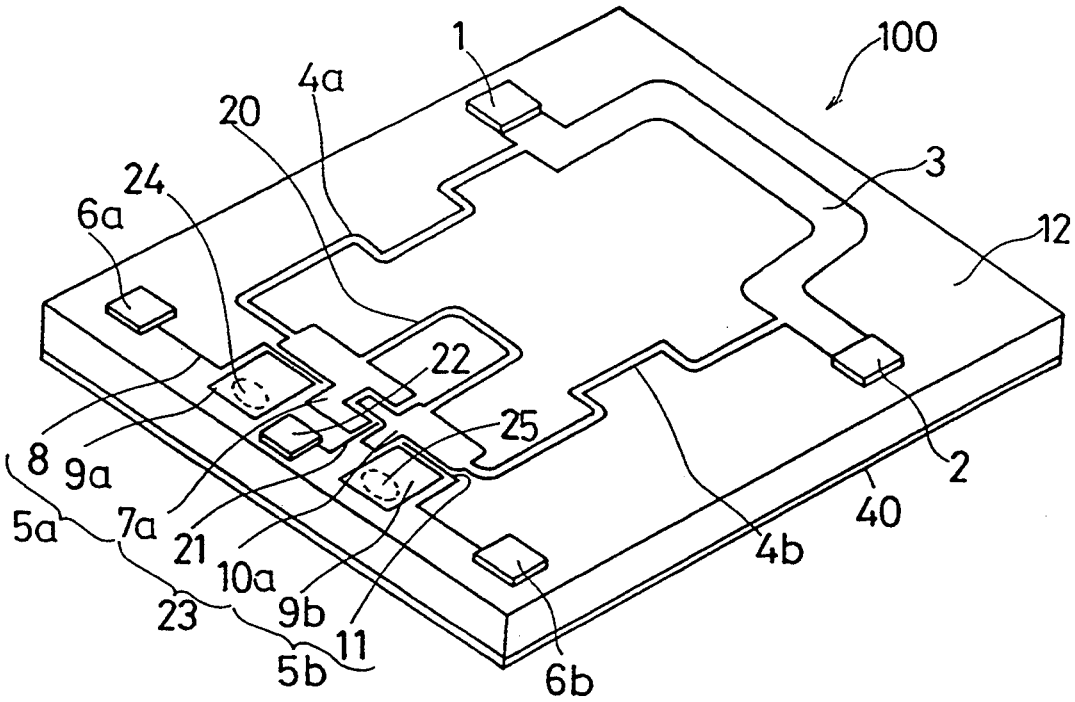
FIG. 1 is a perspective view illustrating a loaded line phase shifter in accordance with a first embodiment of the present invention.
Figure 2:
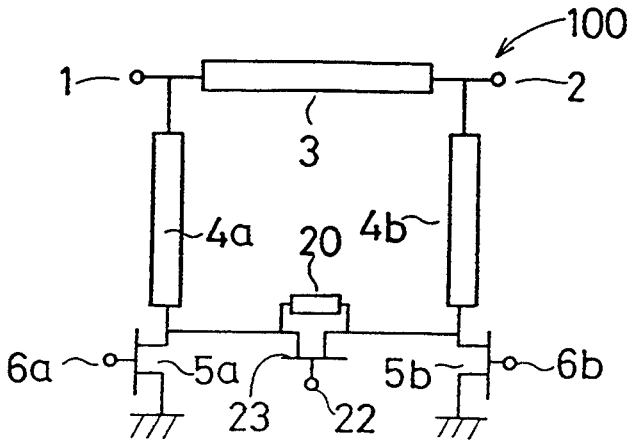
FIG. 2 is an equivalent circuit diagram of the loaded line phase shifter of FIG. 1.
Figure 12:
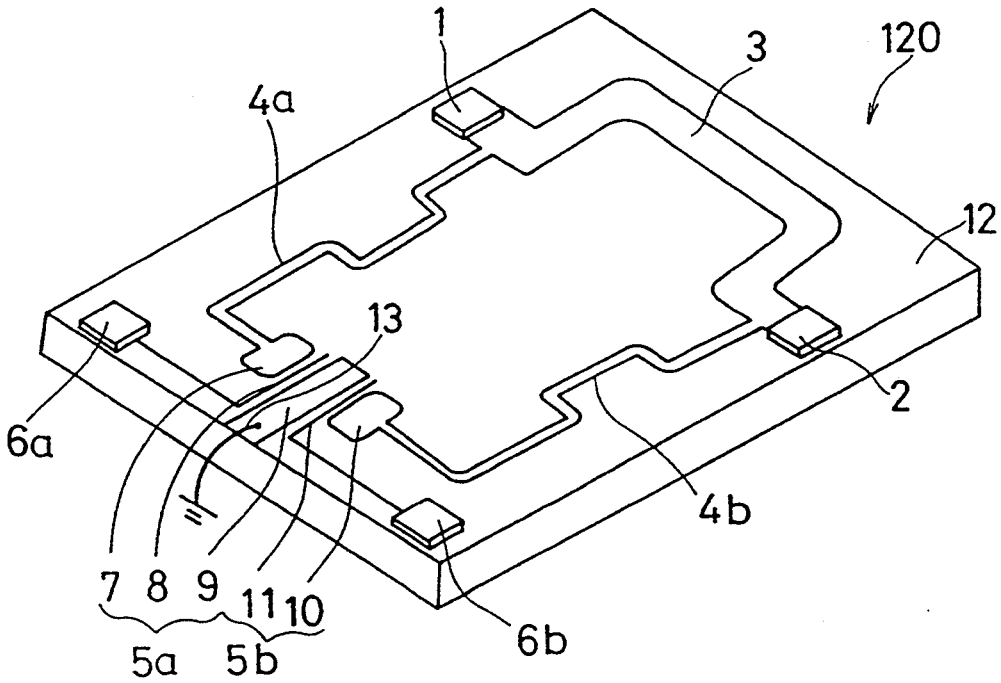
FIG.12 (PRIOR ART)
FIG. 12 is a perspective view illustrating a loaded line phase shifter in accordance with the prior art.
Figure 13:
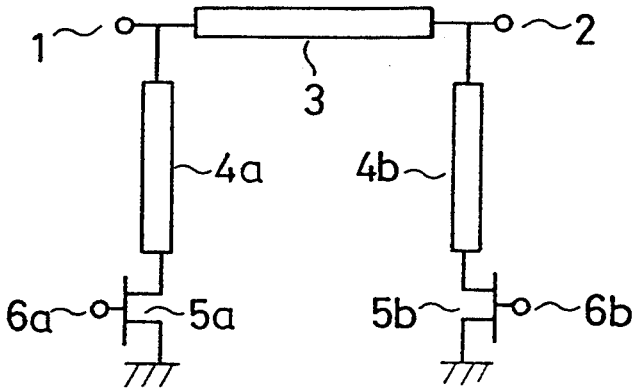
FIG.13 (PRIOR ART)
FIG. 13 is an equivalent circuit diagram of the loaded line phase shifter of FIG. 12.
Figure 14:
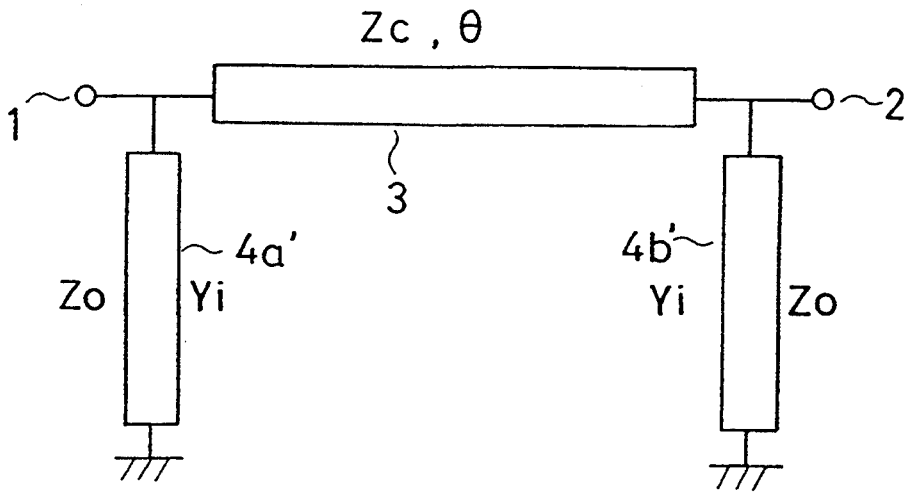
FIG.14 (PRIOR ART)
FIG. 14 is an equivalent circuit diagram of the loaded line phase shifter of FIG. 12.
Figure 15:
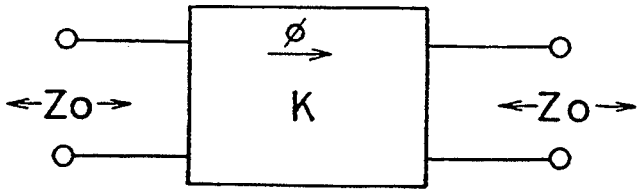
FIG.15 (PRIOR ART)
FIG. 15 is a schematic diagram illustrating a relation between a K matrix and a two-terminal circuit.
Figure 16A:
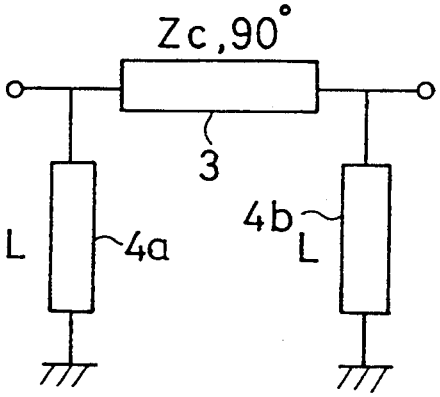
FIG. 16(a) (PRIOR ART)
FIGS. 16(*a*) and 16(*b*) are equivalent circuit diagrams of the loaded line phase shifter of FIG. 12 in an ON state of FETs and an OFF state of FETs; and respectively.
Figure 16B:
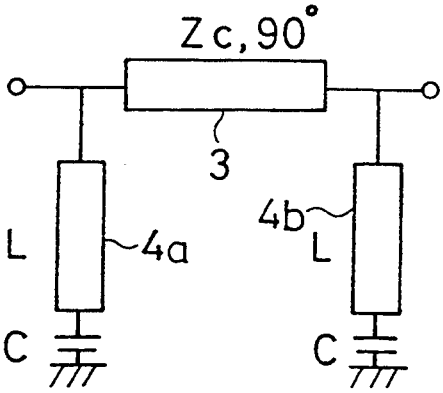
FIG. 16(b) (PRIOR ART)

FIG. 1 is a perspective view illustrating a loaded line phase shifter in accordance with a first embodiment of the present invention, and FIG. 2 is an equivalent circuit diagram thereof. In these figures, the same reference numerals as in FIGS. 12 and 13 designate the same or corresponding parts. In FIG. 1, reference numeral 100 designates a loaded line phase shifter. In the loaded line phase shifter 100, a main line 3 one-quarter wavelength long is disposed on a semiconductor substrate 12 comprising silicon. GaAs, or the like. An input pad (input terminal) 1 and an output pad (output terminal) 2 are disposed at opposite ends of the main line 3. Loaded lines 4*a* and 4*b* are connected to the main line 3 in the vicinity of the input pad 1 and the output pad 2, respectively. FETs 5*a* and 5*b* are connected to the loaded lines 4*a* and 4*b*, respectively. An FET 23 is disposed between the FETs 5*a* and 5*b*. A drain electrode 7*a* of the FET 5*a* also serves as a drain electrode of the FET 23, and a drain electrode 10*a* of the FET 5*b* also serves as a source electrode of the FET 23. A resonant line 20 is connected in parallel with the FET 23 between the source electrode 10*a* and the drain electrode 7*a*. Reference numerals 9*a* and 9*b* designate source electrodes of the FETs 5*a* and 5*b*, respectively and numeral 21 designates a gate of the FET 23. A gate bias pad (terminal) 22 is connected to the gate 21. A grounding conductor 40 is disposed on the rear surface of the substrate 12, which is formed by metallizing a conductor like gold. The source electrodes 9*a* and 9*b* are connected to the grounding conductor 40 on the rear surface of the substrate 12 by via-holes 24 and 25, respectively, whereby the source electrodes 9*a* and 9*b* are grounded.

A description is given of the operation.

Figure 3:
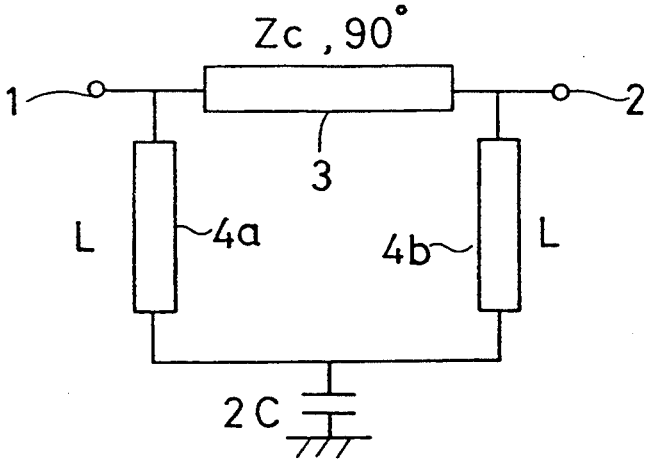
FIG. 3 is an equivalent circuit diagram in a state where a resonance circuit of the loaded line phase shifter of FIG. 1 is closed.

A resonant line having a length at the operating frequency to function as an inductor 20 and the FET 23 are a resonance circuit between the loaded lines 4*a* and 4*b*. By controlling a gate bias voltage applied to the gate 21 at the gate bias terminal 22, the resonance circuit is opened or closed at the operating frequency as capacitance (G) of the FET 23 in its off state, resistance ($Ron \approx 0$) of the FET 23 in its on state, and the inductor 20. When the resonance circuit is open, i.e., when the FET 23 is off, the loaded line phase shifter performs the same operation as the conventional loaded line phase shifter shown in FIG. 13. When the resonance circuit is closed, i.e., when the FET 23 is on, the loaded line phase shifter is equivalent to a circuit shown in FIG. 3. In FIG. 3, Zc is the characteristic impedance of the main line, L is the reactance of the loaded line, and C is the off-capacitance of the FET.

The operation of the loaded line phase shifter in a state where the resonance circuit is open is identical to the operation of the conventional phase shifter and, therefore, repeated description is not necessary.

A description is given of the operation of the loaded line phase shifter in a state where the resonance circuit is closed. When the resonance circuit is closed, the loaded line phase shifter is equivalent to the circuit shown in FIG. 3. Since the main line 3 is one-quarter wavelength long, i.e., $\theta$ is 90°, the reflected waves at the input and output ends cancel each other. Therefore, the following equation (26) also holds in this circuit and a phase shift quantity $\phi$ of a signal traveling through the main line 3 is determined by the susceptance Bi because Zc is a constant.

$$\cos \phi = Bi\ Zc \tag{26}$$

Figure 4:
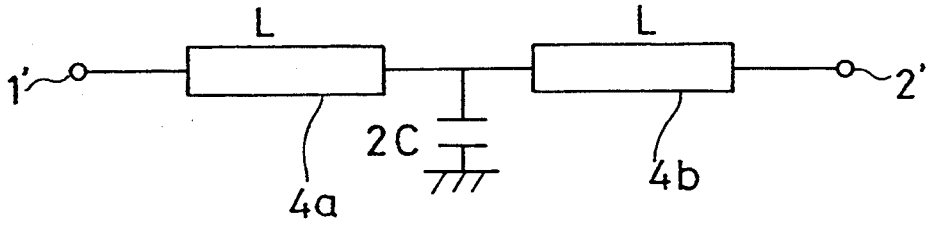
FIG. 4 is an equivalent circuit diagram of part of a load of the loaded line phase shifter of FIG. 1.

Here, only the circuit loaded on the main line 3 is considered separately from the main line 3. FIG. 4 is an equivalent circuit showing the load of FIG. 3, in which reference numeral 1' and 2' designate input and output terminals, respectively. The circuit of FIG. 4 is represented in a K matrix as follows:

$$K = \begin{pmatrix} \cos\theta L & jZL\sin\theta L \\ j\frac{1}{ZL}\sin\theta L & \cos\theta L \end{pmatrix} \begin{pmatrix} 1 & 0 \\ j\omega 2C & 1 \end{pmatrix} \begin{pmatrix} \cos\theta L & jZL\sin\theta L \\ j\frac{1}{ZL}\sin\theta L & \cos\theta L \end{pmatrix} \quad (27)$$

When this K matrix is converted to an admittance matrix according to a general conversion formula, since this circuit is a symmetrical circuit, which means Y11 is equal to Y12, and the conductance is zero, admittances Y11 and Y22 are represented as follows:

$$Y11 = Y22 = \frac{\cos^2\theta L - \sin^2\theta L - 2\omega CZL\sin\theta L}{j2ZL\sin\theta L\cos\theta L - j2\,CZL^2\sin^2\theta L} = B \quad (28)$$

When the equation (25), i.e., $\omega L=(1\tan^2\theta L)/(2\,ZL\tan^2\theta L)$ is substituted, the equation (28) is converted to $$Y11 = Y22 = \frac{\cos^2\theta L - \sin^2\theta L - \frac{1-\tan^2\theta L}{ZL\tan^2\theta L}ZL\sin\theta L}{j2\theta L\sin\theta L\cos\theta L - j\frac{1-\tan^2\theta L}{ZL\tan^2\theta L}} = 0 \quad (29)$$

and it is found that the susceptance of the load circuit is zero.

Figure 17:
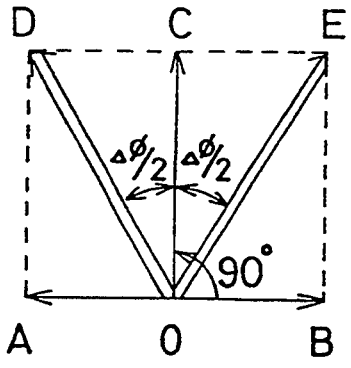
FIG.17 (PRIOR ART)
FIG. 17 is phase diagram of signals traveling through the phase shifters of FIGS. 16(*a*) and 16(*b*).

Since the susceptance is zero and the conductance is also zero, the impedance of the load circuit is infinite. Therefore, when the load circuit shown in FIG. 4 is closed, this load circuit is regarded as equivalent to a circuit with no load on the main line 3, which means that signals traveling through the main line 3 correspond to the vector OC of FIG. 17. Accordingly, when the FET 23 is turned on to close the load circuit, a phase shift quantity of $\Delta\phi/2$ is always obtained in either case where the reflected wave is the vector OE or the vector OD.

In the loaded line phase shifter according to the first embodiment of the present invention, the resonance circuit comprising the inductor 20 and the FET 23 is disposed between the drain electrodes of the source-grounded FETs 5*a* and 5*b* which are connected to the ends of the loaded lines 4*a* and 4*b*, respectively. Therefore, when the FET 23 is turned on to close the resonance circuit, a state where the load is connected to the main line 3 is achieved. On the other hand, when the FET 23 is turned off to open the resonance circuit, a state where the load is not connected to the main line 3 is achieved. As a result, two different phase shift quantities are attained in one phase shifter, resulting in a smaller-sized multiple-bit phase shifter than the conventional shifter.

Figure 5:
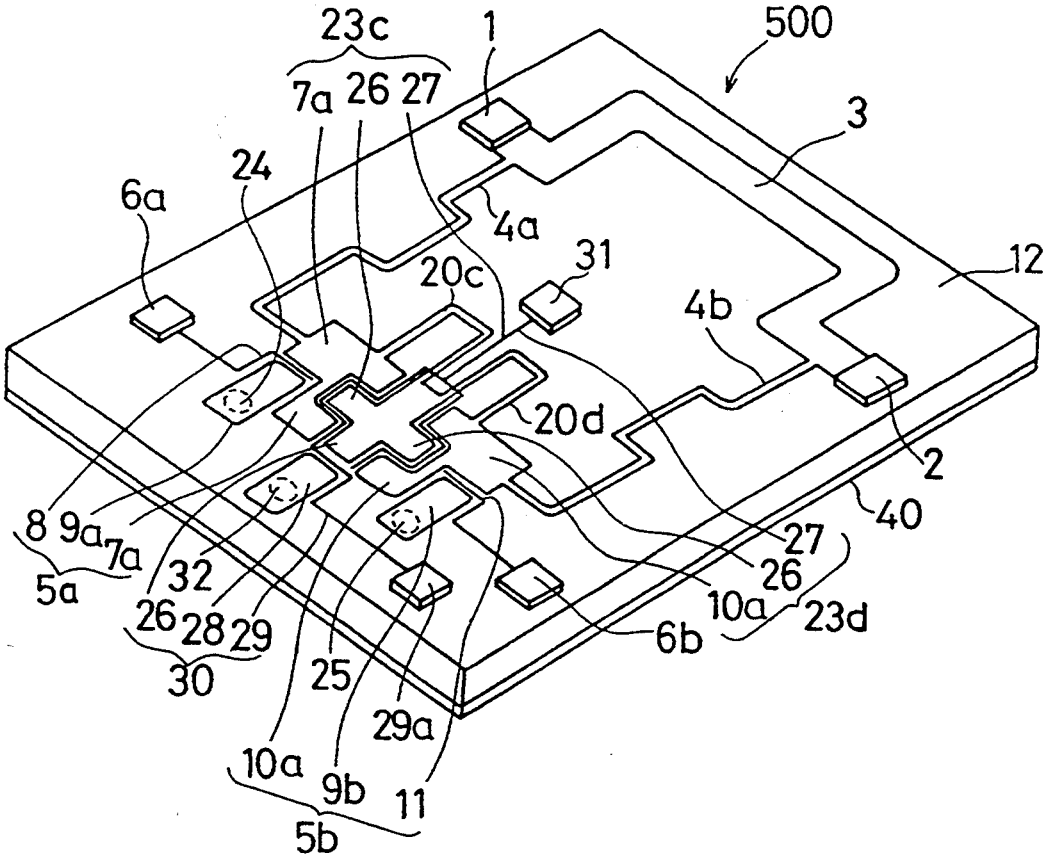
FIG. 5 is a perspective view illustrating a loaded line phase shifter in accordance with a second embodiment of the present invention.
Figure 6:
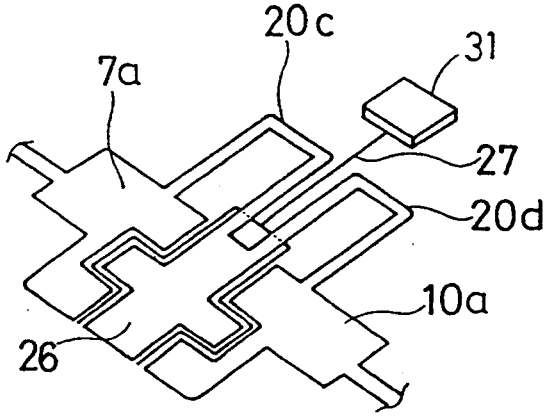
FIG. 6 is an enlarged perspective view of a resonance circuit disposed on the loaded line phase shifter of FIG. 5.
Figure 7:
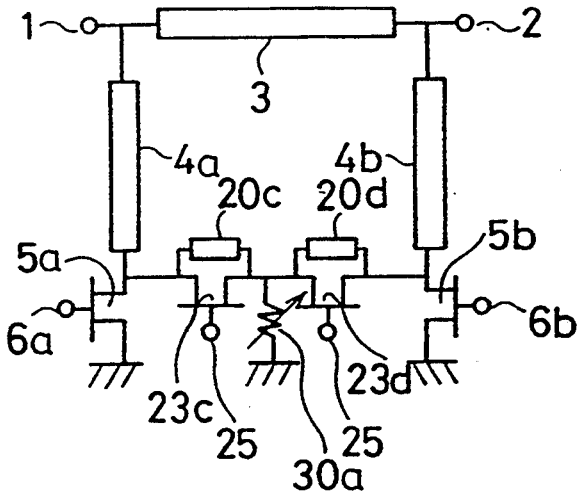
FIG. 7 is an equivalent circuit diagram of the loaded line phase shifter of FIG. 5.

FIG. 5 is a perspective view illustrating a loaded line phase shifter in accordance with a second embodiment of the present invention. FIG. 6 is an enlarged view of a resonance circuit included in the phase shifter of FIG. 5. FIG. 7 is an equivalent circuit diagram Of FIG. 5. In these figures, the same reference numerals as in FIGS. 1 and 2 designate the same or corresponding parts. In the loaded line phase shifter 500, loaded lines 4*a* and 4*b* are connected to opposite ends of the main line 3. An FET 5*a* includes a gate electrode 8, a drain electrode 7*a*, and a source electrode 9*a* which is connected to a grounding conductor 40 by a via-hole 24. An FET 5*b* includes a gate electrode 11, a drain electrode 10*a*, and a source electrode 9*b* which is connected to the grounding conductor 40 by a via-hole 25. The drain electrode 7*a* of the FET 5*a* is connected to an end of the loaded line 4*a*, and the drain electrode 10*a* of the FET 5*b* is connected to an end of the loaded line 4*b*. Two resonance circuits, i.e., a resonance circuit comprising an FET 23*c* and a inductor 20*c* and a resonance circuit comprising an FET 23*d* and a inductor 20*d*, are connected in series between the drain electrodes 7*a* and 10*a* of the source-grounded FETs 5*a* and 5*b*. In addition, a source-grounded FET 30 serving as a variable resistor 30*a* (FIG. 7) is connected to a connection node of the two resonance circuits.

The resonance circuits and the variable resistor will be described in more detail.

The FETs 23*c* and 23*d* of the resonance circuits and the FET 30 as a variable resistor share a drain electrode 26 with each other. The FET 23*c* includes the drain electrode 26, the source electrode 7*a*, and a gate electrode 27, and the inductor 20*c* is connected in parallel with the FET 23*c* between the source electrode 7*a* and the drain electrode 26. The FET 23*d* includes the drain electrode 26, the source electrode 10*a*, and a gate electrode 27, and the inductor 20*d* is connected in parallel with the FET 23*d* between the source electrode 10*a* and the drain electrode 26. The FETs 23*c* and 23*d* share the gate electrode 27 with each other. As shown in FIG. 6, the gate electrode 27, an end of which is connected to the gate bias pad 31, passes through a space between the inductors 20*c* and 20*d* and branches into two. A branch of the gate electrode 27 passes beneath the inductor 20*c* and extends to a space between the drain electrode 26 and the source electrode 7*a* while the other branch passes beneath the inductor 20*d* and extends to a space between the drain electrode 26 and the source electrode 10*a*. On the other hand, the FET 30 includes the drain electrode 26, a source electrode 28, and a gate electrode 29. The source electrode 28 is connected to the grounding conductor 40 on the rear surface of the substrate by the via-hole 32. A gate bias pad 29*a* is connected to the gate electrode 29, and the resistance of the FET 30 is controlled by a voltage applied to the gate bias pad 29*a*, whereby the FET 30 serves as the variable resistor 30*a*.

Figure 8:
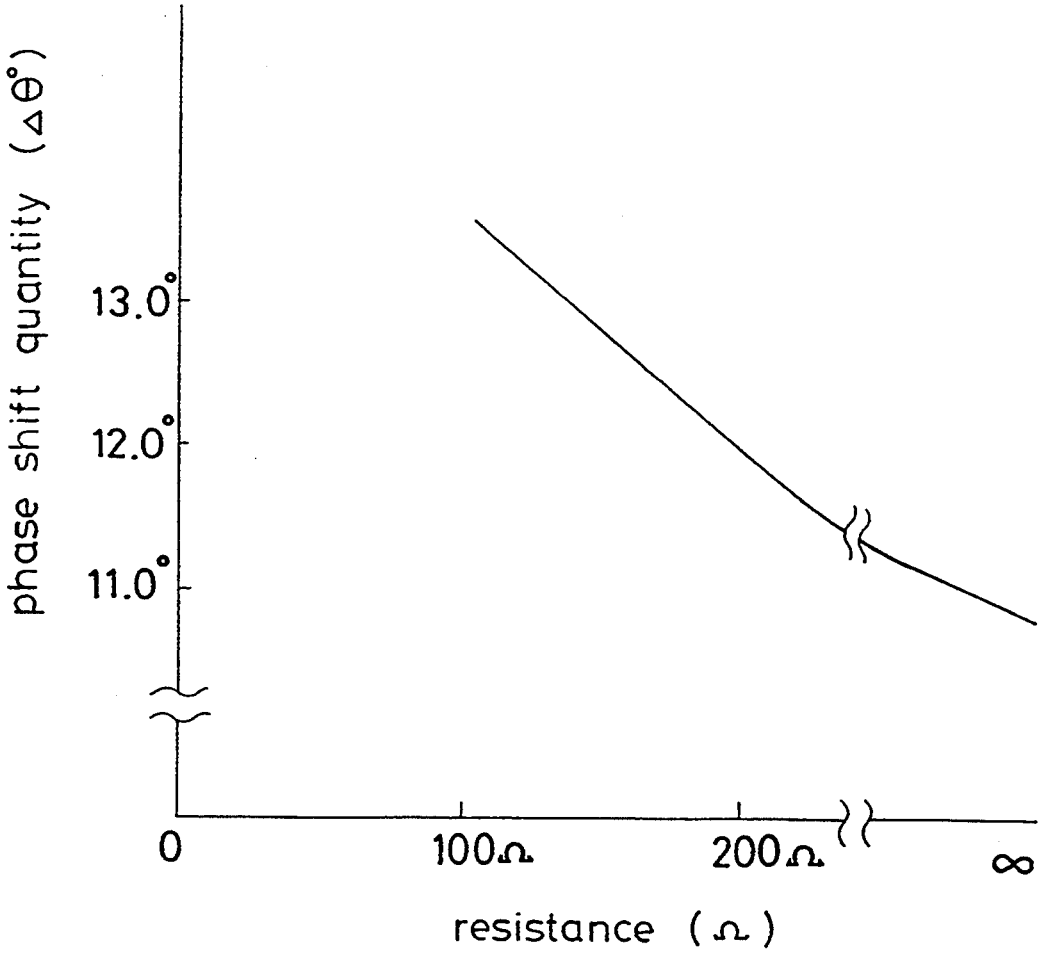
FIG. 8 is a graph illustrating a relation between resistance of a variable resistor and phase shift quantity of the loaded line phase shifter of FIG. 5.

In the loaded line phase shifter according to the second embodiment of the present invention, the source-grounded FETs 5*a* and 5*b* are connected to the loaded lines 4*a* and 4*b*, respectively, the resonance circuit comprising the FET 23*c* and the inductor 20*c* and the resonance circuit comprising the FET 23*d* and the resonance inductor 20*d* are connected in series between the drain electrode 7*a* of the FET 5*a* and the drain electrode 10*a* of the FET 5*b*, and the FET 30 serving as the variable resistor 30*a* is connected to the connection node of the two resonance circuits. In this structure, the resistance of the FET 30 is controlled by varying the gate bias voltage applied to the gate bias pad 29*a* connected to the gate 29 of the FET 30. As a result, as shown in FIG. 8, half of the phase shift quantity of the phase shifter in a state where the loaded lines 4*a* and 4*b* are open is precisely controlled, resulting in a small-sized multiple-bit phase shifter with less variation in the phase shift quantities.

Figure 9:
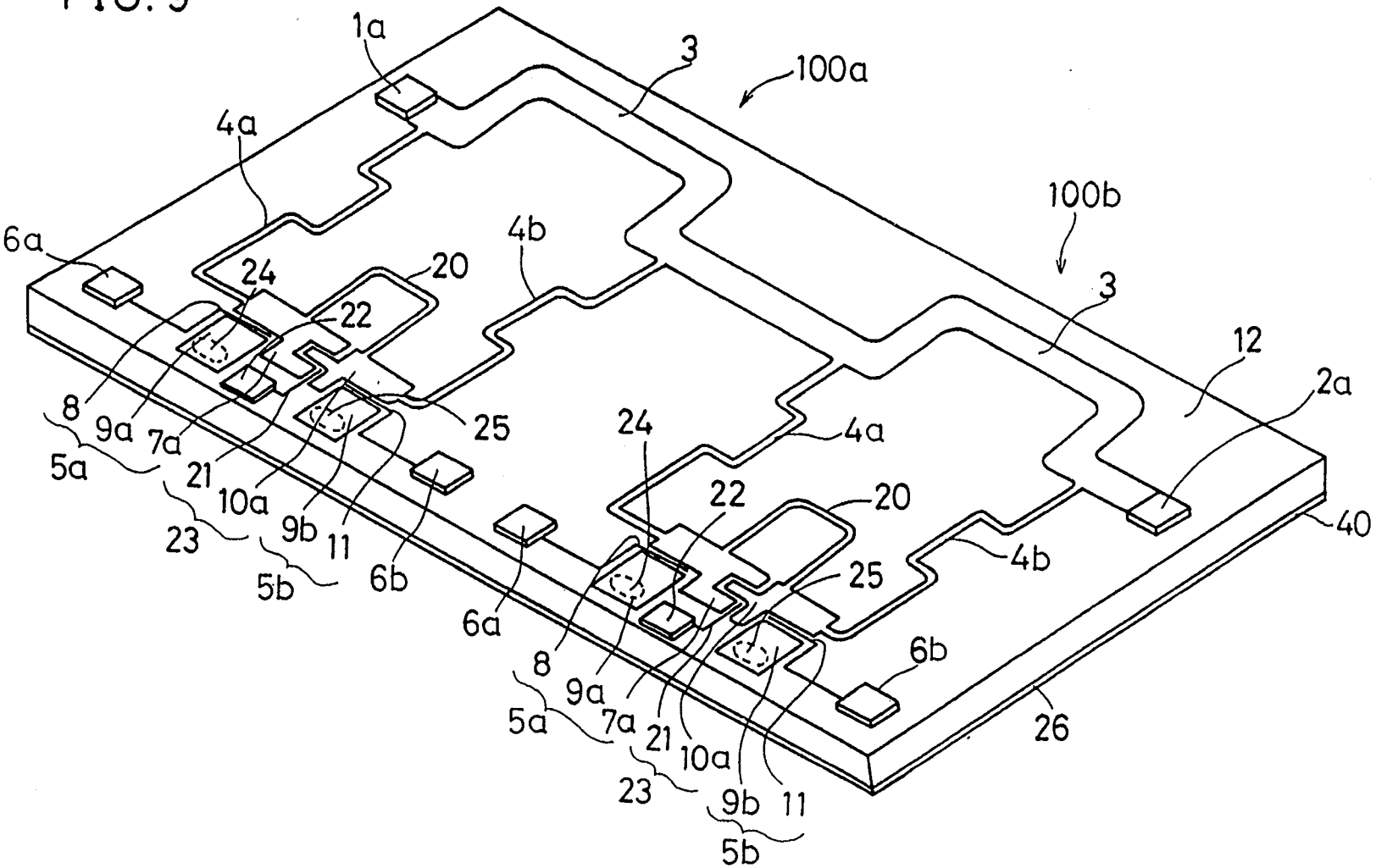
FIG. 9 is a perspective view illustrating a multiple-bit phase shifter in accordance with a third embodiment of the present invention.
Figure 10:
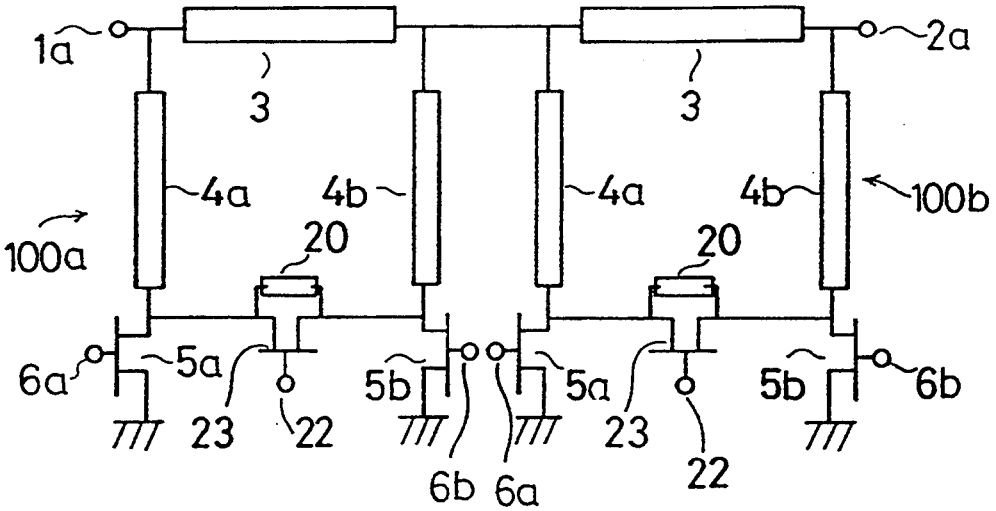
FIG. 10 is an equivalent circuit diagram of the multiple-bit phase shifter of FIG. 9.

FIG. 9 is a perspective view illustrating a multiple-bit phase shifter in accordance with a third embodiment of the present invention, and FIG. 10 is an equivalent circuit diagram thereof. In these figures, the multiple-bit phase shifter comprises a first loaded line phase shifter 100*a* having phase shift quantities of 11.25° and 22.5° and a second loaded line phase shifter 100*b* having phase shift quantities of 33.75° and 67.5°, which are connected in series. The first and second loaded line phase shifters 100*a* and 100*b* are identical to the loaded line phase shifter 100 of FIG. 1 and, therefore, repeated description is not necessary. Reference numerals 1*a* and 2*a* designate an input pad and an output pad of the multiple-bit phase shifter, respectively.

The operation of each loaded line phase shifter is fundamentally identical to the operation of the phase shifter of FIG. 1 and, therefore, does not require repeated description.

Figure 11:
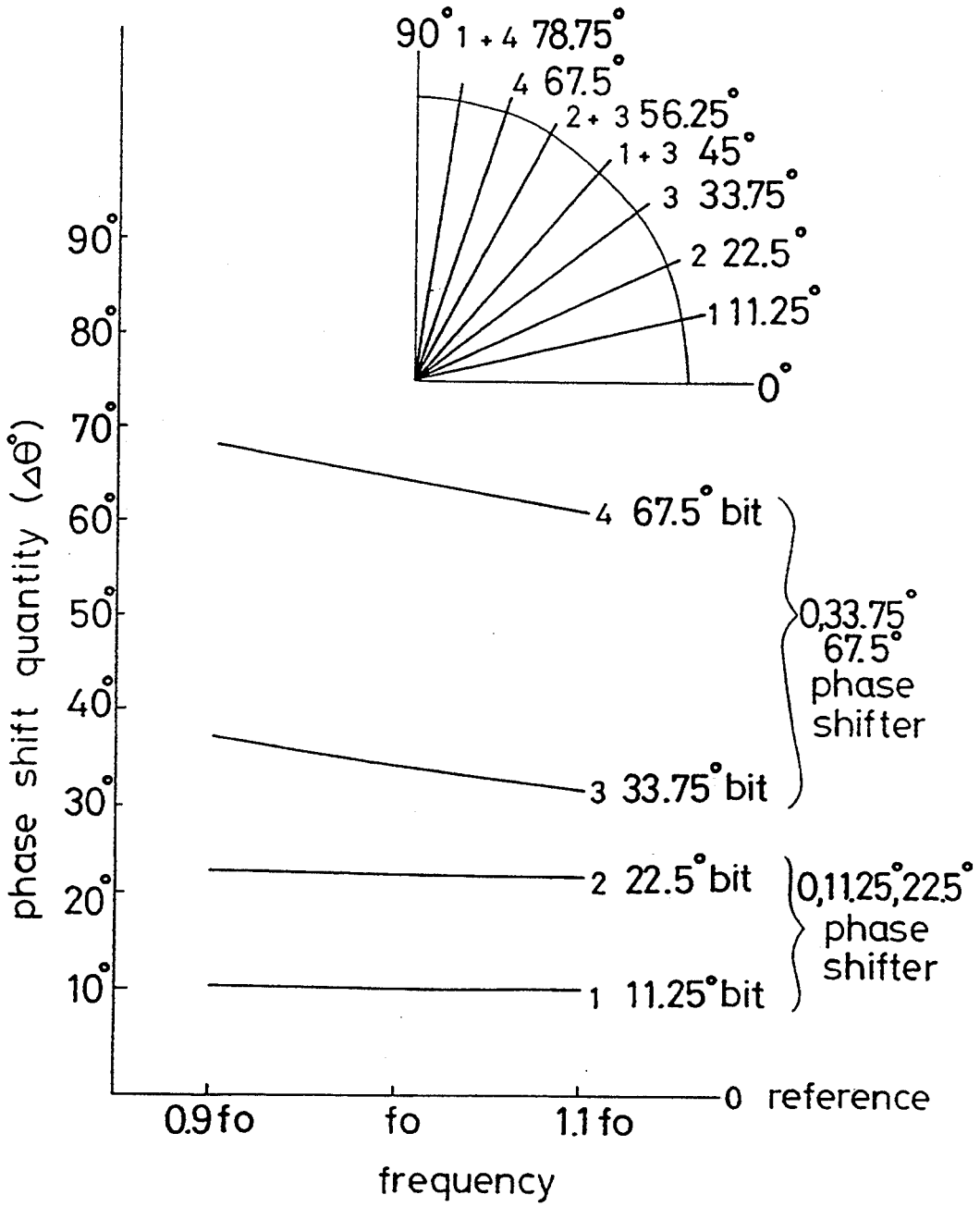
FIG. 11 is a graph illustrating frequency characteristics of the multiple-bit phase shifter of FIG. 9.

In the first loaded line phase shifter 100*a*, a phase shift quantity of 22.5°, which is determined by the reactances of the loaded lines 4*a* and 4*b*, the off-capacitances of the FETs 5*a* and 5*b*, and the characteristic impedance of the main line 3, and half of the phase shift quantity, i.e., 11.25° are obtained. In the second loaded line phase shifter 100*b*, a phase shift quantity of 67.5°, which is determined by the reactances of the loaded lines 4*a* and 4*b*, the off-capacitances of the FETs 5*a* and 5*b*, and the characteristic impedance of the main line 3, and half of the phase shift quantity, i.e., 33.75° are obtained. FIG. 11 is a graph showing frequency characteristics of the multiple-bit phase shifter, which are obtained according to a simulation. In FIG. 11, the ordinate shows phase shift quantities and the abscissa shows frequencies, and fo is a normalization frequency.

In the multiple-bit phase shifter of the third embodiment, as shown in FIG. 11, phase shift quantities of 11.25°, 22.5°, 33.75°, 45°, 56.25°, 67.5°, and 78.75° are obtained from the phase shift quantities of 11.25° and 22.5° of the first loaded line phase shifter 100*a* and the phase shift quantities of 33.75° and 67.5° of the second loaded line phase shifter 100*b* by on-off control of the FETs 23 of the phase shifters 100*a* and 100*b*, i.e., by opening or closing the resonance circuits of the phase shifters each comprising the FET 23 and the inductor 20. This multiple-bit phase shifter has the same function as the conventional multiple-bit phase shifter in which three loaded line phase shifters shown in FIGS. 12 and 13 respectively having phase shift quantities of 11.25°, 22.5°, and 45° are connected in cascade. As a result, the chip size of the multiple-bit phase shifter is significantly reduced as compared with the conventional shifter.

While in the above-described third embodiment, two loaded line phase shifters each having two different phase shift quantities are connected in cascade to attain a multiple-bit phase shifter, three or more loaded line phase shifters may be connected in cascade. Also in this case, the same function as the conventional multiple-bit phase shifter is achieved with fewer loaded line phase shifters.

As is evident from the foregoing description, according to the present invention, two loaded lines are connected to opposite ends of a main transmission line, first and second FETs, source electrodes of which are grounded, are connected to the other ends of the loaded lines, and a resonance circuit comprising a third FET and an inductor is connected between drain electrodes of the two FETs. In this structure, when the resonance circuit is closed, the susceptance of the load comprising the loaded lines and the first and second FETs is equal to zero, resulting in a phase shift quantity equivalent to half of the phase shift quantity obtained when the resonance circuit is open. Therefore, two different phase shift quantities are achieved in one phase shifter, resulting in a small-sized multiple-bit phase shifter.

In addition, source and drain electrodes of the third FET of the resonance circuit also serve as the drain electrodes of the first and second FETs connected to the loaded lines, thereby decreasing the size of the loaded line phase shifter.

In addition, the resonance circuit may comprise two FETs connected in series, two inductors respectively connected between source and drain electrodes of the FETs, i.e., in parallel therewith, and a variable resistor connected to a node of the two FETs. Therefore, the half phase shift quantity obtained when the resonance circuit is closed can be precisely controlled. As a result, a small-sized and highly-reliable multiple-bit phase shifter is achieved.

What is claimed is:

1. A loaded line phase shifter comprising:

a semiconductor substrate;

a main transmission line one-quarter wavelength long between opposite ends and disposed on said semiconductor substrate;

first and second loaded lines, each loaded line having first and second ends, the first ends of said first and second loaded lines being respectively connected to opposite ends of said main line;

first and second FETs, each FET having a drain electrode, a source electrode, and a gate electrode, said drain electrodes of said first and second FETs being connected to the second ends of said first and second loaded lines, respectively, and said source electrodes of said first and second FETs being grounded; and a resonant circuit comprising a third FET and an inductor connected in parallel and connected to said drain electrodes of said first and second FETs.

2. The loaded line phase shifter of claim 1 wherein said third FET has a source electrode, a gate electrode, and a drain electrode, said drain electrodes of said first and second FETs are connected to said source and drain electrodes of said third FET, respectively, and said inductor is connected across said source and drain electrodes of said third FET.

3. A loaded line phase shifter comprising:

a semiconductor substrate;

a main transmission line one-quarter wavelength long between opposite ends and disposed on said semiconductor substrate;

first and second loaded lines, each loaded line having first and second ends, the first ends of said first and second loaded lines being respectively connected to opposite ends of said main line;

first and second FETs, each FET having a drain electrode, a source electrode, and a gate electrode, said drain electrodes of said first and second FETs being connected to the second ends of said first and second loaded lines, respectively, and said source electrodes of said first and second FETs being grounded; and a resonant circuit comprising a third FET and a first inductor connected in parallel and a fourth FET and a second inductor connected in parallel, said third and fourth FETs being connected in series, that series connection of said third and fourth FETs connecting said drain electrode of said first FET to said drain electrode of said second FET, and a variable resistance element connected between a connection node of said third and fourth FETs and ground.

4. The loaded line phase shifter of claim 3 wherein said variable resistance element comprises a fifth FET having a source electrode connected to ground.

5. A multiple bit phase shifter comprising a plurality of loaded line phase shifters connected in cascade on a semiconductor substrate wherein each loaded line phase shifter comprises:

a main transmission line one-quarter wavelength long between opposite ends and disposed on said semiconductor substrate;

first and second loaded lines, each loaded line having first and second ends, the first ends of said first and second loaded lines being respectively connected to opposite ends of said main line;

first and second FETs, each FET having a drain electrode, a source electrode, and a gate electrode, said drain electrodes of said first and second FETs being connected to the second ends of said first and second loaded lines, respectively, and said source electrodes of said first and second FETs being grounded;

a resonant circuit comprising a third FET and an inductor connected in parallel and connected to said drain electrodes of said first and second FETs.

* * * * *